US011619431B2

(12) United States Patent
Senf, Jr.

(10) Patent No.: US 11,619,431 B2
(45) Date of Patent: Apr. 4, 2023

(54) METHOD OF DEFROSTING A MULTIPLE HEAT ABSORPTION HEAT EXCHANGER REFRIGERATION SYSTEM

(71) Applicant: Carrier Corporation, Palm Beach Gardens, FL (US)

(72) Inventor: Raymond L. Senf, Jr., Palm Beach Gardens, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 100 days.

(21) Appl. No.: 17/045,944

(22) PCT Filed: Feb. 26, 2019

(86) PCT No.: PCT/US2019/019512
§ 371 (c)(1),
(2) Date: Oct. 7, 2020

(87) PCT Pub. No.: WO2019/199385
PCT Pub. Date: Oct. 17, 2019

(65) Prior Publication Data

US 2021/0364205 A1 Nov. 25, 2021

Related U.S. Application Data

(60) Provisional application No. 62/657,182, filed on Apr. 13, 2018.

(51) Int. Cl.
*F25B 47/00* (2006.01)
*F25B 5/02* (2006.01)
*F25B 49/02* (2006.01)

(52) U.S. Cl.
CPC ..... *F25B 47/006* (2013.01); *F25B 5/02* (2013.01); *F25B 49/02* (2013.01); *F25B 2400/01* (2013.01)

(58) Field of Classification Search
CPC .... F25B 2400/01; F25B 47/006; F25B 49/02; F25B 5/02
See application file for complete search history.

(56) References Cited

U.S. PATENT DOCUMENTS 3,138,006 A 6/1964 Moorman
4,122,688 A 10/1978 Mochizuki
(Continued)

FOREIGN PATENT DOCUMENTS

CN 1130532 4/2001
CN 106247654 12/2016
(Continued)

OTHER PUBLICATIONS

International Preliminary Report on Patentability for International Application No. PCT/US2019019512 dated Oct. 22, 2020.
(Continued)

*Primary Examiner* — Henry T Crenshaw
(74) *Attorney, Agent, or Firm* — Carlson, Gaskey & Olds, P.C.

(57) ABSTRACT

A method of operating a refrigeration system. The method includes operating a multi-temperature refrigeration system that has a plurality of heat absorption heat exchangers in a single temperature mode. A number of the plurality of heat absorption heat exchangers are determined that require defrosting a single heat absorption heat exchanger is directed into a different operational state when the number of heat absorption heat exchangers that require defrosting is equal to one. E of the plurality of heat absorption heat exchangers is directed into a defrost mode when the number of heat absorption heat exchangers that requires defrosting is more than one.

14 Claims, 2 Drawing Sheets

(56) References Cited

U.S. PATENT DOCUMENTS

| | | | | |
|---|---|---|---|---|
| 4,151,723 | A | 5/1979 | Gardner | |
| 4,276,755 | A | 7/1981 | Perez | |
| 4,356,703 | A | 11/1982 | Vogel | |
| 4,723,414 | A | 2/1988 | Hurutachi | |
| 4,979,371 | A | 12/1990 | Larson | |
| 5,583,273 | A | 12/1996 | Colle | |
| 6,622,498 | B2 | 9/2003 | Park | |
| 6,694,754 | B1 | 2/2004 | Schenk | |
| 7,213,407 | B2 | 5/2007 | Hu | |
| 7,461,515 | B2 | 12/2008 | Wellman | |
| 7,698,902 | B2 | 4/2010 | Kang et al. | |
| 8,424,324 | B2 | 4/2013 | Petrenko | |
| 9,423,164 | B2 | 8/2016 | Amdersson | |
| 2006/0254308 | A1 | 11/2006 | Yokoyama | |
| 2007/0113567 | A1* | 5/2007 | Ahn | F25D 17/042 62/186 |
| 2012/0023975 | A1* | 2/2012 | Yoon | F25D 11/022 62/81 |

FOREIGN PATENT DOCUMENTS

| | | |
|---|---|---|
| CN | 106907877 | 6/2017 |
| DE | 202008012203 | 2/2009 |
| DE | 202008005337 | 8/2009 |
| EP | 1022171 | 7/2000 |
| EP | 3279588 | 2/2018 |
| GB | 2542721 | 3/2017 |
| JP | 2006118849 | 5/2006 |
| KR | 20100131693 | * 12/2010 |
| KR | 101124872 | 3/2012 |
| WO | 0237038 | 5/2002 |
| WO | 2008120862 | 10/2008 |
| WO | 2016000750 | 7/2016 |

OTHER PUBLICATIONS

International Search Report and Written Opinion for International Application No. PCT/US2019019512 dated Jun. 26, 2019.

* cited by examiner

METHOD OF DEFROSTING A MULTIPLE HEAT ABSORPTION HEAT EXCHANGER REFRIGERATION SYSTEM

CROSS-REFERENCE TO RELATED APPLICATIONS

This application claims priority to U.S. Provisional Application No. 62/657,182, which was filed on Apr. 13, 2018 and is incorporated herein by reference.

BACKGROUND

Typically, refrigeration systems are used to transport and distribute cargo, or more specifically perishable goods and environmentally sensitive goods (herein referred to as perishable goods) that may be susceptible to temperature, humidity, and other environmental factors. Perishable goods may include but are not limited to fruits, vegetables, grains, beans, nuts, eggs, dairy, seed, flowers, meat, poultry, fish, ice, and pharmaceuticals. Advantageously, cold chain distribution systems allow perishable goods to be effectively transported and distributed without damage or other undesirable effects.

Refrigerated trucks and trailers are commonly used to transport perishable goods in a cold chain distribution system. A transport refrigeration system is mounted to the truck or to the trailer in operative association with a cargo space defined within the truck or trailer for maintaining a controlled temperature environment within the cargo space.

Conventionally, transport refrigeration systems used in connection with refrigerated trucks and refrigerated trailers include a transport refrigeration unit having a refrigerant compressor, a condenser with one or more associated condenser fans, an expansion device, and an evaporator with one or more associated evaporator fans, which are connected via appropriate refrigerant lines in a closed refrigerant flow circuit. Air or an air/gas mixture is drawn from the interior volume of the cargo space by means of the evaporator fan(s) associated with the evaporator, passed through the airside of the evaporator in heat exchange relationship with refrigerant whereby the refrigerant absorbs heat from the air, thereby cooling the air. The cooled air is then supplied back to the cargo space. During operation, the cargo space may be accessed frequently, which leads to temperature and moisture variations in the cargo space.

SUMMARY

In one exemplary embodiment, a method of operating a refrigeration system. The method includes operating a multi-temperature refrigeration system that has a plurality of heat absorption heat exchangers in a single temperature mode. A number of the plurality of heat absorption heat exchangers are determined that require defrosting a single heat absorption heat exchanger is directed into a different operational state when the number of heat absorption heat exchangers that require defrosting is equal to one. E of the plurality of heat absorption heat exchangers is directed into a defrost mode when the number of heat absorption heat exchangers that requires defrosting is more than one.

In a further embodiment of the above, the plurality of heat absorption heat exchangers includes at least three heat absorption heat exchangers.

In a further embodiment of any of the above, the single heat absorption heat exchanger requires defrosting.

In a further embodiment of any of the above, the refrigeration system continues to operate in the single temperature mode when the number of heat absorption heat exchangers that require defrosting is equal to one.

In a further embodiment of any of the above, the single heat absorption heat exchanger in the different operational state is fluidly separated from a remainder of the multi-temperature refrigeration system by closing an expansion device corresponding to the single heat absorption heat exchanger.

In a further embodiment of any of the above, a fan associated with the single heat absorption heat exchanger in the different operation state is disengaged when the single heat absorption heat exchanger is located in a frozen compartment.

In a further embodiment of any of the above, the different operational state operates a fan adjacent the single heat absorption heat exchanger when the single heat absorption heat exchanger is located in a perishable compartment.

In a further embodiment of any of the above, It's determined if a second heat absorption heat exchanger requires defrosting in addition to the single heat absorption heat exchanger and directing the refrigeration system into the defrost mode when the single heat absorption heat exchanger and the second heat absorption heat exchanger require defrosting.

In a further embodiment of any of the above, the multi-temperature refrigeration system includes at least three heat absorption heat exchangers.

In a further embodiment of any of the above, each of the plurality of heat absorption heat exchangers is directed into a defrost mode. Each of the plurality of heat absorption heat exchangers is heated with a resistance heater.

In another exemplary embodiment, a controller for a refrigeration system includes a processor and a memory including computer-executable instructions that, when executed by the processor, cause the processor to perform operations. The operations include operating a multi-temperature refrigeration system that has a plurality of heat absorption heat exchangers in a single temperature mode. A number of the plurality of heat absorption heat exchangers that require defrosting is determined. A single heat absorption heat exchanger is directed into a different operational state when the number of heat absorption heat exchangers that require defrosting is equal to one. Each of the plurality of heat absorption heat exchangers is directed into a defrost mode when the number of heat absorption heat exchangers that requires defrosting is.

In a further embodiment of any of the above, the plurality of heat absorption heat exchangers includes at least three heat absorption heat exchangers.

In a further embodiment of any of the above, the single heat absorption heat exchanger requires defrosting.

In a further embodiment of any of the above, the operations further includes continuing to operate the refrigeration system in the single temperature mode when the number of heat absorption heat exchangers that require defrosting is equal to one.

In a further embodiment of any of the above, the operations further includes fluidly separating the single heat absorption heat exchanger in the different operational state from a remainder of the multi-temperature refrigeration system by closing an expansion device that corresponds to the single heat absorption heat exchanger.

In a further embodiment of any of the above, the operations further include a fan associated with the single heat absorption heat exchanger in the different operation state is disengaged when the single heat absorption heat exchanger is located in a frozen compartment.

In a further embodiment of any of the above, the different operational state operates a fan adjacent the single heat absorption heat exchanger when the single heat absorption heat exchanger is located in a perishable compartment.

In a further embodiment of any of the above, the operations further include determining if a second heat absorption heat exchanger requires defrosting in addition to the single heat absorption heat exchanger. The refrigeration system is directed into the defrost mode when the single heat absorption heat exchanger and the second heat absorption heat exchanger require defrosting.

In a further embodiment of any of the above, the multi-temperature refrigeration system includes at least three heat absorption heat exchangers.

In a further embodiment of any of the above, each of the plurality of heat absorption heat exchangers is directed into a defrost mode. Each of the plurality of heat absorption heat exchangers is heated with a resistance heater.

DETAILED DESCRIPTION

Figure 1:
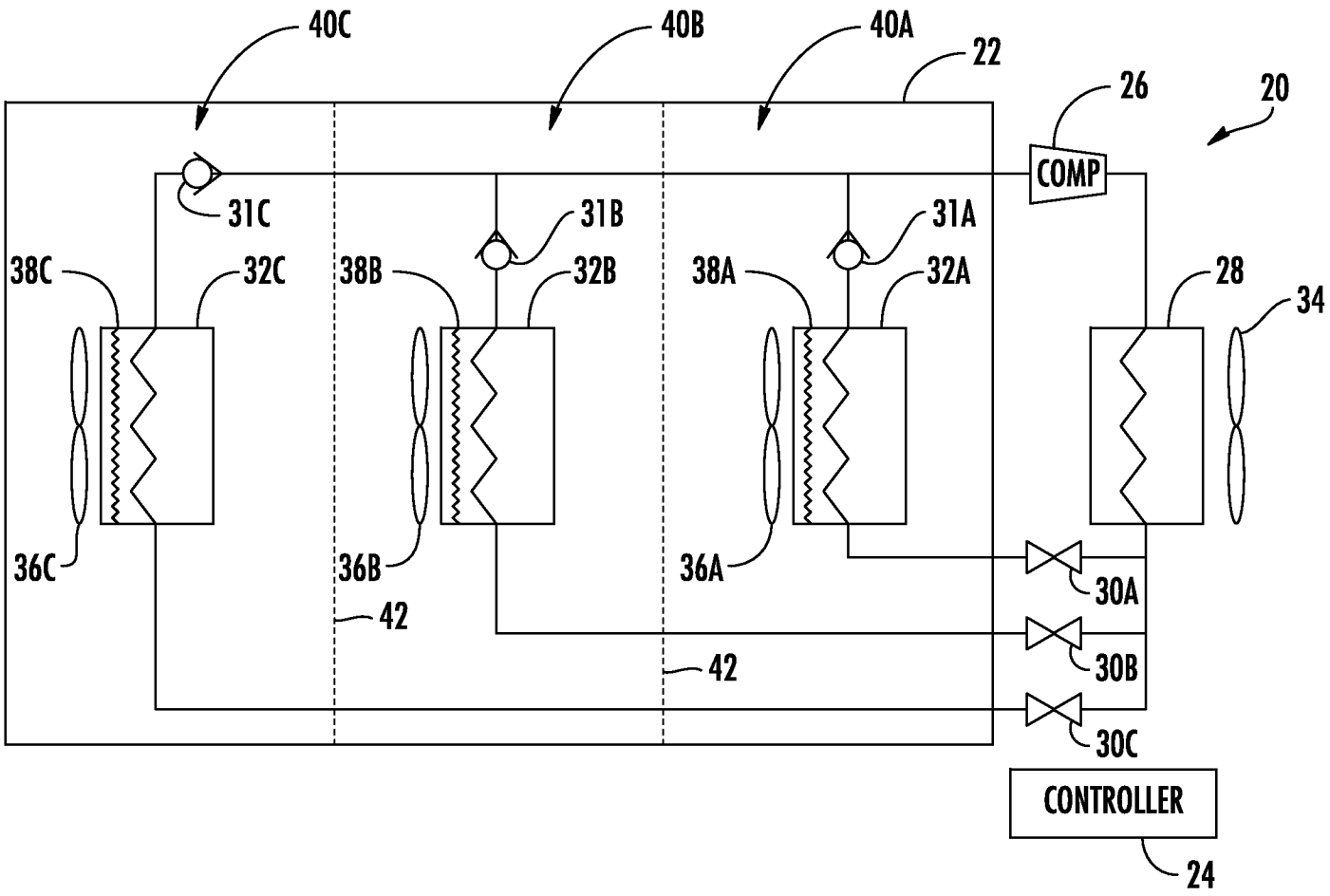
FIG. 1 is a schematic view illustrating a transport refrigeration system.

FIG. 1 illustrates a transport refrigeration system 20 associated with a cargo space 22, such as a refrigerated cargo space. A controller 24 manages operation of the refrigeration system 20 to establish and regulate a desired product storage temperature within a refrigerated cargo space 22. The cargo space 22 may be the cargo box of a trailer, a truck, a seaboard shipping container or an intermodal container wherein perishable cargo, such as, for example, produce, meat, poultry, fish, dairy products, cut flowers, and other fresh or frozen perishable products, is stowed for transport.

The refrigeration system 20 includes a refrigerant compression device 26, a refrigerant heat rejection heat exchanger 28, and a first expansion device 30A, a second expansion device 30B, and a third expansion device 30C in fluid communication with a respective one of a first refrigerant heat absorption heat exchanger 32A, a second refrigerant heat absorption heat exchanger 32B, and a third refrigerant heat absorption heat exchanger 32C in a closed loop refrigerant circuit and arranged in a conventional refrigeration cycle. Although only three heat absorption heat exchangers 32A, 32B, and 32C are shown in the illustrated example, additional heat absorption heat exchangers could be used in connection with additional expansion devices 30.

In the illustrated example, the expansion devices 30A, 30B, 30C are electronic expansion valves and a first check valve 31A, a second check valve 31B, and a third check valve 31C is located downstream of a respective first, second, and third heat absorption heat exchanger 32A, 32B, 32C, respectively, to isolate a corresponding heat absorption heat exchanger 32A, 32B, 32C when the controller 24 closes one or more of the first, second, or third expansion devices 30A, 30B, 30C.

Alternatively, an electronic solenoid valve upstream of a thermal expansion valve could be used for the expansion devices 30A, 30B, and 30C. The controller 24 would control refrigerant flow through controlling the electronic solenoid valves, while the thermal expansion valve would be mechanically based and operate independently of the controller 24.

The refrigeration system 20 also includes one or more fans 34 associated with the heat rejection heat exchanger 28. Additionally, each of the first, second, and third heat absorption heat exchangers 32A, 32B, and 32C are associated with a respective first, second, and third fan 36A, 36B, and 36C. The refrigeration system 20 may also include a first, second, and third electric resistance heater 38A, 38B, 38C associated with a respective one of the first, second, and third heat absorption heat exchangers 32A, 32B, and 32C. It is to be understood that other components (not shown) may be incorporated into the refrigerant circuit as desired, including for example, but not limited to, a suction modulation valve, a receiver, a filter/dryer, an economizer circuit.

The heat rejection heat exchanger 28 may, for example, comprise one or more refrigerant conveying coiled tubes or one or more tube banks formed of a plurality of refrigerant conveying tubes extending between respective inlet and outlet manifolds. The fan(s) 34 are operative to pass air, typically ambient air, across the tubes of the heat rejection heat exchanger 28 to cool refrigerant vapor passing through the tubes.

The first, second, and third heat absorption heat exchangers 32A, 32B, and 32C may each, for example, also comprise one or more refrigerant conveying coiled tubes or one or more tube banks formed of a plurality of refrigerant conveying tubes extending between respective inlet and outlet manifolds. The first, second, and third fans 36A, 36B, and 36C are operative to pass air drawn from the temperature controlled cargo space 22 across the tubes of the heat absorption heat exchanger 32 to heat refrigerant passing through the tubes and cool the air. The air cooled in traversing the heat absorption heat exchangers 32A, 32B, and 32C is supplied back to the temperature controlled cargo space 22.

The refrigerant compression device 26 may comprise a single-stage or multiple-stage compressor such as, for example, a reciprocating compressor or a scroll compressor.

In the refrigeration system 20, the controller 24 is configured for controlling operation of the refrigeration system 20 including, but not limited to, operation of various components of the refrigerant system 20 to provide and maintain a desired thermal environment within the refrigerated cargo space 22. The controller 24 may be an electronic controller including a microprocessor and an associated memory bank. The controller 24 controls operation of various components of the refrigeration system 20, such as the refrigerant compression device 26, expansion devices 30A, 30B, 30C, the fans 34, 36A, 36B, and 36C, and the electric resistance heaters 38A, 38B, and 38C.

During operation of the refrigeration system 20, the first, second, and third heat absorption heat exchangers 32A, 32B, and 32C, are capable of maintaining a respective separate first, second, and third compartment 40A, 40B, 40C at separate temperatures. Alternatively, the first, second, and third heat absorption heat exchangers 32A, 32B, and 32C, are capable of maintaining the respective separate first, second, and third compartments 40A, 40B, 40C at a single temperature. Additionally, diving walls 42 used to separate the first, second, and third compartments 40A, 40B, 40C in the cargo space 22 are removable such that the individual first, second, and third compartments 40A, 40B, 40C become a single shared compartment that can be maintained at a single temperature when the controller 24 directs the refrigeration system 20 into a single temperature mode.

Depending on the application, the first, second, and third compartments 40A, 40B, and 40C, can be of varying sizes and the respective first, second, and third heat absorption heat exchangers 32A, 32B, and 32C can also be of varying sizes to accommodate the individual compartments. The first, second, and third heat absorption heat exchangers 32A, 32B, and 32C can also have varying water capacities, such that the heat absorption heat exchangers can hold varying amounts of water before the heat absorbing function degrades and a defrost is needed.

Because the first, second, and third heat absorption heat exchangers 32A, 32B, and 32C can be of varying sizes and water capacities, each of the first, second, and third heat absorption heat exchangers 32A, 32B, and 32C may need to be defrosted at varying times. Furthermore, even if the first, second, and third heat absorption heat exchangers 32A, 32B, and 32C were the same size and water capacity, their location within the cargo space 22 can lead to each of the heat absorption heat exchangers 32A, 32B, and 32C requiring a defrosting at different times.

For example, when one of the first, second, and third heat absorption heat exchangers 32A, 32B, and 32C is located near an access opening 44 in the cargo space 22, that one heat exchanger will likely have to manage a greater amount of moisture in the air due to moisture entering the cargo space 22 through the access opening 44 during loading and unloading. Therefore, instead of placing all of the heat absorption heat exchangers 32A, 32B, and 32C into a defrost mode when any one of the heat absorption heat exchangers 32A, 32B, and 32C require defrosting, the control logic discussed below and illustrated in FIG. 2 will manage defrosting of the refrigeration system 20.

Figure 2:
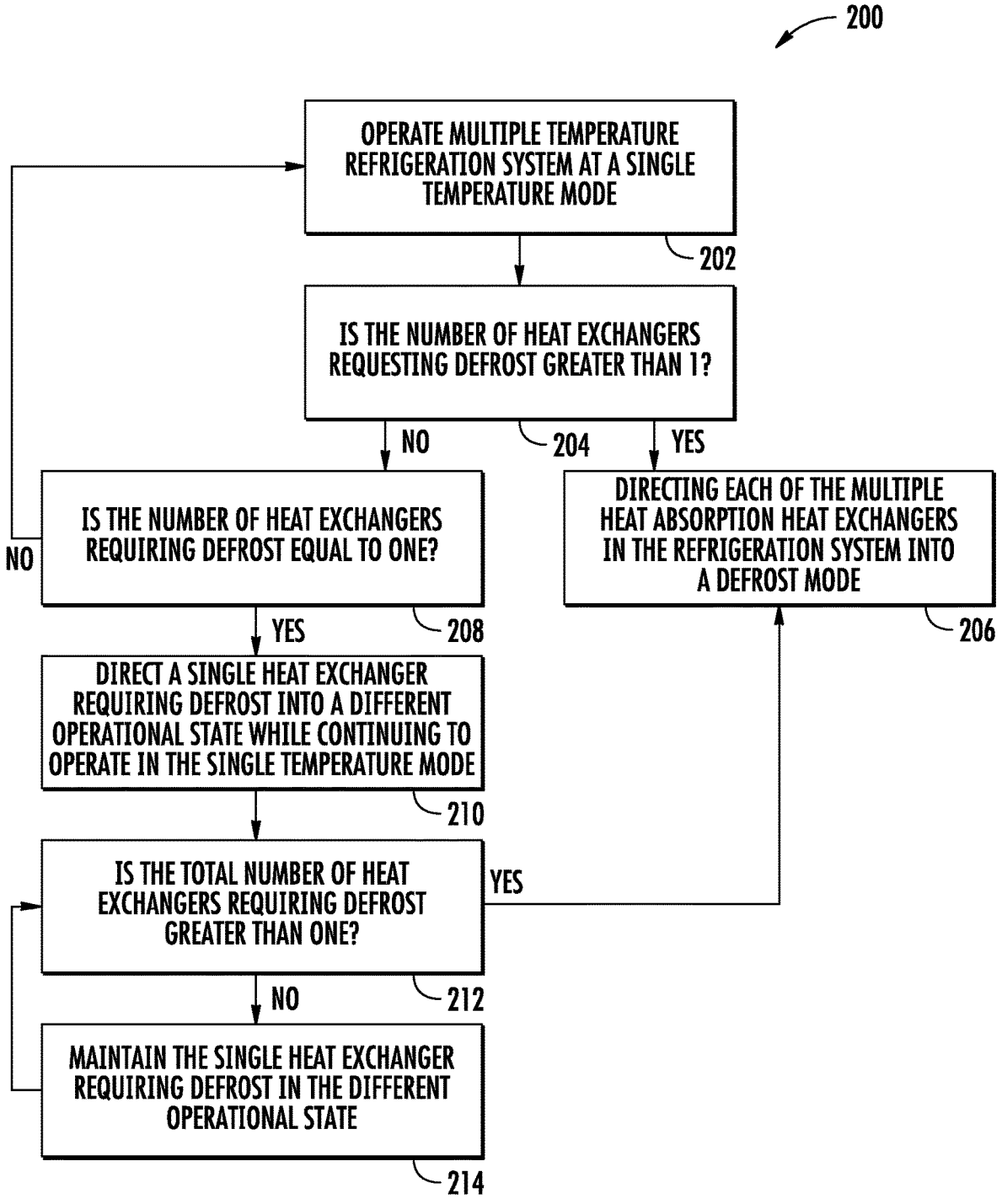
FIG. 2 is a flow diagram illustrating a method of operating the transport refrigeration system.

FIG. 2 illustrates a flow diagram 200 of a method of operating the refrigeration system 20. The method begins at block 202 with the refrigeration system 20 operating in a single temperature mode. In the illustrated example, the refrigeration system 20 is capable of operating each of the first, second, and third heat absorption heat exchangers 32A, 32B, and 32C at varying degrees of refrigeration with the controller 24 controlling a respective one of the first, second and third, expansion devices 30A, 30B, 30C.

During operation of the refrigeration system 20, the controller 24 could determine that at least one of the first, second, and third heat absorption heat exchangers 32A, 32B, 32C requires defrosting due to decreased cooling capacity from ice formation. If the controller 24 determined that more than 1 of the heat absorption heat exchangers 32A, 32B, 32C requires defrosting (block 204), the controller 24 will direct all of the heat absorption heat exchangers 32A, 32B, 32C into a defrost mode (block 206).

By requiring more than one of the heat absorption heat exchangers 32 to require defrosting before entering the defrosting mode for the refrigeration system 20, the refrigeration system 20 as a whole will not be limited by the water capacity of the smallest heat absorption heat exchanger 32A, 32B, 32C in the refrigeration system 20. This allows the refrigeration system 20 to run for longer periods of time without being interrupted for defrosting. Once the refrigeration system 20 has passed through the defrosting mode, the system will continue to operate in the single temperature mode (block 202).

If the controller 24 determines that refrigeration system does not have more than one heat absorption heat exchangers 32 requiring a defrost (block 204), the controller will determine if a single heat absorption heat exchanger 32 requires a defrost (block 208). Generally, first heat absorption heat exchanger 32A will function as the master heat exchanger and have the greatest amount of cooling capacity and water capacity. The second and third heat absorption heat exchangers 32B and 32C have a reduced amount of cooling capacity and liquid retention when compared to the first heat absorption heat exchanger 32A.

Because the second and third heat exchangers 32B and 32C have reduced water capacity compared to the first heat absorption heat exchanger 32A, the second and third heat absorption heat exchangers 32B and 32C will likely require defrosting more frequently. Additionally, it is likely that the second and third heat absorption heat exchangers 32B and 32C are located in a portion of the cargo space 22 closer to the access opening 44 such that they will be impacted more by moisture entering the cargo space 22 during loading and unloading than the first heat absorption heat exchanger 32A.

If the controller determines that only a single heat absorption heat exchanger 32 requires defrosting, the controller 24 will direct the single heat absorption heat exchanger 32 into a different operational state while continuing to operate the refrigeration system 20 in the single temperature mode (block 210). The different operational state can include fluidly isolating the single heat absorption heat exchanger 32 from the refrigeration system 20 by closing the corresponding expansion device 30. Additionally, the controller 24 can cause the corresponding fan 36 to continue to run even though heat exchanger has been fluidly isolated when the single heat absorption heat exchanger 32 is in a perishable compartment or disengaging the corresponding fan 36 when the single heat absorption heat exchanger 32 is in a frozen compartment.

Alternatively, the controller 24 can continue to allow refrigerant to run through the single heat absorption heat exchanger 32 in the different operational state in a regular manner. The controller 24 will continue to determine if more than one heat absorption heat exchanger 32 requires a defrost (block 212). If the controller 24 determines that more than one heat absorption heat exchanger 32 requires a defrost, the controller 24 will direct all of the heat absorption heat exchangers 32A, 32B, 32C into a defrost mode (block 206). If only the single heat absorption heat exchanger 32 continues to require a defrost, the controller 24 will maintain the single heat absorption heat exchanger 32 in the different operational state (block 214) while continuing to monitor for an addition heat absorption heat exchanger 32 requiring a defrost (block 212).

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of operating a refrigeration system, the method comprising:

operating a multi-temperature refrigeration system in a single temperature mode, wherein the refrigeration system includes at least three heat absorption heat exchangers each located in a corresponding one of at least three compartments and each heat absorption heat exchanger is capable of maintaining a corresponding one of the at least three compartments at a single temperature in the single temperature mode;

determining a number of the at least three heat absorption heat exchangers that require defrosting;

directing a single heat absorption heat exchanger requiring defrosting into a defrost mode when the number of heat absorption heat exchangers that require defrosting is equal to one; and directing each of the at least three heat absorption heat exchangers into a defrost mode when the number of heat absorption heat exchangers that requires defrosting is more than one.

2. The method of claim 1, further comprising:

continuing to operate the refrigeration system at the single temperature when the number of heat absorption heat exchangers that require defrosting is equal to one.

3. The method of claim 1, further comprising:

fluidly separating the single heat absorption heat exchanger in the defrost mode from a remainder of the multi-temperature refrigeration system by closing an expansion valve corresponding to the single heat absorption heat exchanger.

4. The method of claim 3, further comprising:

disengaging a fan associated with the single heat absorption heat exchanger in the defrost mode when the single heat absorption heat exchanger is located in a frozen compartment.

5. The method of claim 3, wherein the defrost mode operates a fan adjacent the single heat absorption heat exchanger when the single heat absorption heat exchanger is located in a perishable compartment.

6. The method of claim 3, further comprising:

determining if a second heat absorption heat exchanger requires defrosting in addition to the single heat absorption heat exchanger and directing the refrigeration system into the defrost mode when the single heat absorption heat exchanger and the second heat absorption heat exchanger require defrosting.

7. The method of claim 1, wherein directing each of the at least three heat absorption heat exchangers into a defrost mode includes heating each of the at least three heat absorption heat exchangers with a resistance heater.

8. A controller for a refrigeration system comprising:

a processor; and a memory comprising computer-executable instructions that, when executed by the processor, cause the processor to perform operations, the operations comprising:

operating a multi-temperature refrigeration system having a plurality of compartments and at least three heat absorption heat exchangers in a single temperature mode, wherein the at least three heat absorption heat exchangers each located in a corresponding one of at least three compartments and each heat absorption heat exchanger is capable of maintaining a corresponding one of the plurality of compartments at a single temperature in the single temperature mode;

determining a number of the at least three heat absorption heat exchangers that require defrosting;

directing a single heat absorption heat exchanger requiring defrosting into a defrost mode when the number of heat absorption heat exchangers that require defrosting is equal to one; and directing each of the at least three heat absorption heat exchangers into a defrost mode when the number of heat absorption heat exchangers that requires defrosting is more than one.

9. The controller of claim 8, wherein the operations further comprise:

continuing to operate the refrigeration system at the single temperature when the number of heat absorption heat exchangers that require defrosting is equal to one.

10. The controller of claim 8, wherein the operations further comprise:

fluidly separating the single heat absorption heat exchanger in the defrost mode from a remainder of the multi-temperature refrigeration system by closing an expansion valve corresponding to the single heat absorption heat exchanger.

11. The controller of claim 10, wherein the operations further comprise:

disengaging a fan associated with the single heat absorption heat exchanger in the defrost mode when the single heat absorption heat exchanger is located in a frozen compartment.

12. The controller of claim 10, wherein the defrost mode operates a fan adjacent the single heat absorption heat exchanger when the single heat absorption heat exchanger is located in a perishable compartment.

13. The controller of claim 10, wherein the operations further comprise:

determining if a second heat absorption heat exchanger requires defrosting in addition to the single heat absorption heat exchanger and directing the refrigeration system into the defrost mode when the single heat absorption heat exchanger and the second heat absorption heat exchanger require defrosting.

14. The controller of claim 8, wherein directing each of the at least three heat absorption heat exchangers into a defrost mode includes heating each of the at least three heat absorption heat exchangers with a resistance heater.

* * * * *